US007706737B2

(12) United States Patent
Lang

(10) Patent No.: US 7,706,737 B2
(45) Date of Patent: Apr. 27, 2010

(54) MIXED OUTPUT PRINTING SYSTEM

(75) Inventor: Joseph H. Lang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 1183 days.

(21) Appl. No.: 11/291,583

(22) Filed: Nov. 30, 2005

(65) Prior Publication Data

US 2007/0120934 A1 May 31, 2007

(51) Int. Cl.

| | |
|---|---|
| ***G03G 15/00*** | (2006.01) |
| ***G03G 21/00*** | (2006.01) |
| ***B65H 29/00*** | (2006.01) |
| ***B65H 39/00*** | (2006.01) |

(52) U.S. Cl. ..... 399/397; 399/402; 399/405; 399/407; 271/184; 271/185

(58) Field of Classification Search ..... 399/361, 399/381, 382, 397, 402, 403, 404, 405, 407; 271/8.1, 9.01, 9.02, 9.04, 9.05, 9.13, 184–192; *G03G 15/00, 21/00; B65H 29/00, 5/00, B65H 39/00*

See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,021,837 | A | 6/1991 | Uto et al. |
| 5,080,340 | A | 1/1992 | Hacknauer et al. |
| 5,090,683 | A | 2/1992 | Kamath et al. |
| 5,095,342 | A | 3/1992 | Farrell et al. |
| 5,150,168 | A | 9/1992 | Kamath et al. |
| 5,159,395 | A | 10/1992 | Farrell et al. |
| 5,208,640 | A | 5/1993 | Horie et al. |
| 5,272,511 | A | 12/1993 | Conrad et al. |
| 5,316,279 | A | 5/1994 | Corona et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |

(Continued)

FOREIGN PATENT DOCUMENTS

JP 09025048 A * 1/1997

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Daniel J Colilla
*Assistant Examiner*—'Wyn' Q Ha
(74) *Attorney, Agent, or Firm*—Fay Sharpe LLP

(57) ABSTRACT

The disclosed embodiments are directed to the printing of mixed output jobs automatically as a single integrated job. More particularly, a merging module connects two print systems, for example, at approximately 90 degrees to one another, although other configurations are possible. The merging module includes at least one sheet rotator in a plane that is common to both the paper paths of both print engines. It also includes at least two bypass paths (one above and one below the rotator) to route the two paper paths around the rotator and enable both print engines to deliver their output to the appropriate finishing device.

15 Claims, 9 Drawing Sheets

U.S. PATENT DOCUMENTS 5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,629,762 A 5/1997 Mahoney et al.
5,646,740 A 7/1997 Webster
5,649,698 A * 7/1997 Auerbach et al. ..... 271/225
5,710,968 A 1/1998 Clark et al.
5,724,642 A 3/1998 Cala
5,778,377 A 7/1998 Marlin et al.
5,884,910 A 3/1999 Mandel
5,995,721 A 11/1999 Rourke et al.
6,059,284 A 5/2000 Wolf et al.
6,076,080 A 6/2000 Morscheck et al.
6,125,248 A 9/2000 Moser
6,241,242 B1 6/2001 Munro
6,244,584 B1 * 6/2001 Holbrook et al. ..... 271/3.07
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,776,404 B1 * 8/2004 Milillo et al. ..... 270/58.18
6,819,906 B1 11/2004 Herrmann et al.
6,925,283 B1 8/2005 Mandel et al.
6,959,165 B2 10/2005 Mandel et al.
7,175,173 B2 2/2007 Anzai et al.
7,403,926 B2 * 7/2008 Herbert ..... 705/410
2002/0018235 A1 2/2002 Ryan et al.
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 * 12/2004 Lofthus et al. ..... 400/582
2005/0023742 A1 2/2005 Tamura et al.
2005/0053404 A1 3/2005 Zeller et al.
2005/0121847 A1 6/2005 Anzai et al.
2005/0158098 A1 7/2005 Mandel et al.
2006/0291018 A1 * 12/2006 Lang et al. ..... 358/540
2007/0120305 A1 * 5/2007 Mandel et al. ..... 270/1.01

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow et al.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.

* cited by examiner

MIXED OUTPUT PRINTING SYSTEM

BACKGROUND

Illustrated herein are methods and systems relating to image and document production. Embodiments will be described in detail with reference to mixed output production using electrophotographic or xerographic marking or printing engines. However, it is to be appreciated that embodiments associated with other marking or rendering technologies are contemplated.

Traditionally, a printer prints a job as the job arrives to the printer. In a networked printer environment, a network server presents the jobs queued at the network to the printer for printing sequentially. The printer is traditionally a two-phase work center. In the first phase of the printing function, the printer processes the job for rasterization. The process is known as raster image processing (or RIP). In the second phase of the printing function, the printer prints the job.

In order to provide increased production speed, document processing systems that include a plurality of printing or marking engines have been developed. These so-called "cluster printing systems" enable high print speeds or print rates by grouping a number of slower speed marking engines in parallel. The systems are very cost competitive and have an advantage over single engine systems because of their redundancy. For example, if one marking engine fails, the system can still function at reduced throughput by using the remaining marking engines. However, to print jobs containing a mix of monochrome, MICR (Magnetic Ink Character Recognition) or color prints with cluster printing systems, print shops typically split the job into parts and run those parts on separate color, MICR or monochrome print engine, transferring the output prints to either an off-line collator or to an in-line inserter to assemble the pages into the job correctly. Alternatively, the customer may have to run the entire monochrome+color job on a color machine or run a monochrome+MICR job on a MICR machine. Both of these cases result in a higher printing cost for the job.

In this regard, several companies provide elementary mixed color and monochrome page job processing software, such as Xerox FreeFlow, EFI Balance, and SOFHA MultiFLOW. Typically, the mixed color/monochrome job is rasterized or "RIPped" a first time and all color pages are printed on a color printer. A job ticket is automatically created. The job ticket programs the color pages as inserts into the monochrome print stream. The color pages are then unloaded from the color printer and placed in an inserter tray in the monochrome engine. The job is then run again, this time printing all the monochrome pages. The pre-programmed job ticket inserts the color pages into the monochrome page stream in the correct location. While this process is somewhat simpler than performing these tasks entirely manually, it does require human interaction that is both time intensive and error prone in that the color pages may be loaded in incorrect order, with incorrect orientation and the like.

Thus, there is a need for a means to provide the customer the ability to print mixed output jobs (e.g., monochrome+color, monochrome+MICR, etc.) automatically as a single integrated job, while still allowing the customer the flexibility to use that same equipment to run separate monochrome and color or MICR jobs simultaneously without reconfiguring the hardware.

CROSS-REFERENCE TO RELATED APPLICATIONS

The following applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

Application Ser. No. 11/235,979, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

Application Ser. No. 11/236,099, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE", and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. application Ser. No. 10,761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498), filed Mar. 25, 2005, entitled "INVERTER WITH RETURN/BYPASS PAPER PATH," by Robert A. Clark;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;.

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/234,553, filed Sep. 23, 2005, entitled "MAXIMUM GAMUT STRATEGY FOR THE PRINTING SYSTEMS", by Michael C. Mongeon;

U.S. application Ser. No. 11/234,468, filed Sep. 23, 2005, entitled "PRINTING SYSTEM", by Eric Hamby, et al.;

U.S. application Ser. No. 11/247,778, filed Oct. 11, 2005, entitled "PRINTING SYSTEM WITH BALANCED CONSUMABLE USAGE", by Charles Radulski, et al.;

U.S. application Ser. No. 11/248,044, filed Oct. 12, 2005, entitled "MEDIA PATH CROSSOVER FOR PRINTING SYSTEM", by Stan A. Spencer, et al.; and U.S. application Ser. No. 11/292,163, filed contemporaneously herewith, entitled "RADIAL MERGE MODULE FOR PRINTING SYSTEM, " by Barry P. Mandel, et al.

INCORPORATION BY REFERENCE

The following references, the disclosures of which are incorporated by reference in their entireties, relate to what have been variously called "tandem engine" printers, "cluster printing," and "output merger" or "interposer" systems: U.S. Pat. No. 4,579,446; U.S. Pat. No. 4,587,532; U.S. Pat. No. 5,272,511; U.S. Pat. No. 5,568,246; U.S. Pat. No. 5,570,172; U.S. Pat. No. 5,995,721; U.S. Pat. No. 5,596,416; U.S. Pat. No. 6,402,136; U.S. Pat. No. 6,925,283; U.S. Pat. No. 6,959,165; a 1991 "Xerox Disclosure Journal" publication of November-December 1991, Vol. 16, No. 6, pp. 381-383; and the Xerox Aug. 3, 2001 "TAX" publication product announcement entitled "Cluster Printing Solution Announced."

BRIEF DESCRIPTION

The disclosed embodiments enable the printing of mixed output jobs automatically as a single integrated job. For example, a merging module connects two print systems at approximately 90 degrees to one another, although other configurations are possible. The merging module includes at least one sheet rotator in a plane that is common to both the paper paths of both print engines. It also includes at least two bypass paths (one above and one below the rotator) to route the two paper paths around the rotator and enable both print engines to deliver their output to the appropriate finishing device.

In one embodiment a printing system comprises a first print engine that produces output to a print stream, wherein the output comprises at least one sheet of print media; a second print engine that produces output to the print stream, wherein the output comprises at least one sheet of print media; a merging module connected between the first and second print engines to receive the output from each of the print engines, wherein the merging module includes at least two sheet rotators; a sheet buffering apparatus coupled to the merging module for buffering the output from each of the print engines; and at least one finisher connected to the merging module.

In another embodiment an apparatus for an image rendering system having at least two marking engines producing output consisting of sheets of print media for at least one finisher comprises a merging module connected between a first marking engine and a second marking engine for processing output from each of the first and second marking engines, the merging module including at least two sheet rotators, at least two decision gates, and at least four sheet paths, the sheet paths comprising an upper bypass path, a lower bypass path.

In yet another embodiment a mixed output printing system comprises a first print engine that produces output to a print stream; a second print engine that produces output to the print stream; a first merging module connected between the first and second print engines to receive the output from the first and second print engines, wherein the merging module includes a first sheet buffering apparatus; a first finisher for receiving output from the first merging module; a third print engine that produces output to the print stream; a first transport module that transports the print stream from the first merging module to a second merging module that is located between the third print engine, the first transport module and the second finisher, a fourth print engine that produces output to the print stream; a second transport module that transports the print stream from the second merging module to a third merging module and is connected between the fourth print engine and third and fourth finishers and wherein the third and fourth finishers receive the output from the third merge module and the second and third merging modules each include a sheet buffering apparatus.

In yet another embodiment a xerographic printing system comprises a first print engine that produces output to a print stream, wherein the first print engine comprises a monochrome print engine, a MICR print engine, or a color print engine; a second print engine that produces output to the print stream, wherein the second print engine comprises a monochrome print engine, a MICR print engine, or a color print engine; a merging module connected between the first and second print engines to receive the output from each of the print engines, wherein the merging module includes at least two sheet rotators, an upper bypass path, a lower bypass path, a first merge path, a second merge path, and at least two decision gates; a sheet buffering apparatus coupled to the merging module for buffering the output from each of the print engines; and at least one finisher connected to the merging module.

DETAILED DESCRIPTION

Figure 1:
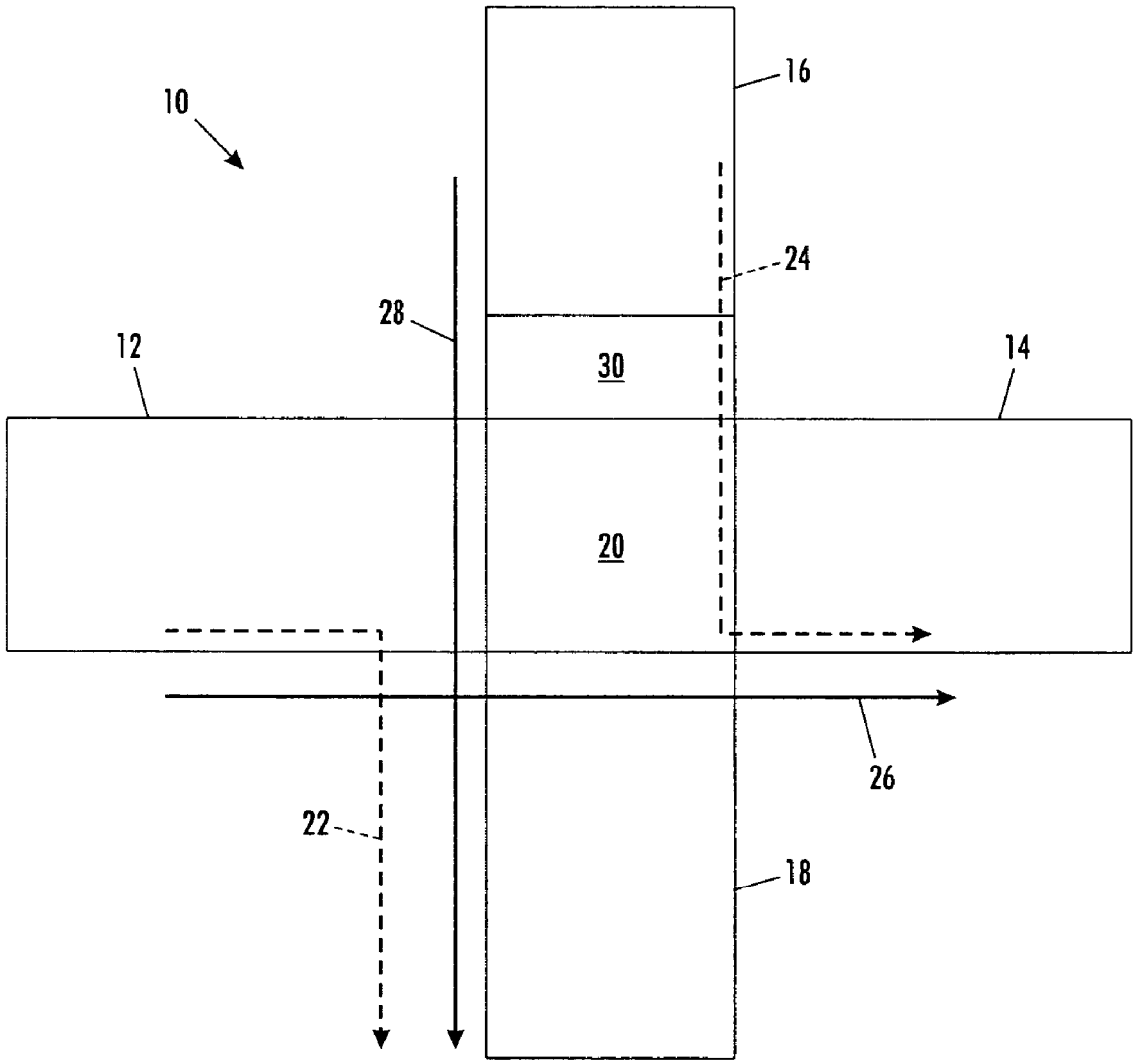
FIG. 1 is a simplified block diagram of an image rendering system incorporating a merging module and a buffer.

FIG. 1 illustrates an image (or document) rendering (or printing) system 10 such as a xerographic printing system, which is suitable for incorporating embodiments of the methods and systems disclosed herein. The system 10 is described in greater detail in U.S. application Ser. No. 11/166,581, filed Jun. 24, 2005, entitled "MIXED OUTPUT PRINT CONTROL METHOD AND SYSTEM," by Joseph H. Lang, et al., which is incorporated by reference herein.

The disclosed system may be operated and controlled by appropriate operation of conventional control systems. It is well-known and preferable to program and execute imaging, printing, paper handling, and other control and logic functions of reproduction apparatus and finishers with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, a disclosed control system or method may be implemented partially or fully in hardware, using standard logic circuits or single chip VLSI designs.

The terms "marking engine" or "printer" as used herein broadly encompasses various printers, copiers or multifunction machines or systems, xerographic or otherwise, unless otherwise defined in a claim. The terms "print media" or "sheet" as used herein refer to a physical sheet of paper, plastic, or other suitable physical substrate for images, whether precut or web fed. A "copy sheet" may be abbreviated as a "copy" or called a "hardcopy." A "print job" is normally a set of related sheets, usually one or more collated copy sets copied from a set of original document sheets or electronic document page images, from a particular user, or otherwise related.

As shown in FIG. 1, the printing system 10 includes a first marking or print engine 12 (e.g., a monochrome, color or MICR marking engine), a corresponding first finisher 14, a second marking engine 16 (e.g., a color, MICR or second monochrome marking engine), and a corresponding second finisher 18. The image rendering system 10 further includes a merging module 20 for mixed output print control, which contains several paths for print media (e.g., paper), including at least one "rotate and redirect" path 22 (a second path 24 is shown in FIG. 1), a first "bypass" path 26, and a second "bypass" path 28.

As known in the art, the printing system 10 typically includes any number of image output terminals (IOT) and image input devices, such as a scanner, imaging camera or other device. Each image output terminal typically includes a plurality of input media trays and an integrated marking engine (e.g., the first marking engine 12).

Each of the corresponding finishers 14, 18 typically includes main job output trays. Depending on a document processing job description and on the capabilities of the finishers 14, 18, one or both of the main job output trays may collect loose pages or sheets, stapled or otherwise bound booklets, shrink wrapped assemblies or otherwise finished documents. The finishers 14, 18 receive sheets or pages from the merging module 20 and process the pages according to a print job description associated with the pages or sheets and according to the capabilities of the finishers 14,18. Of course, it is to be understood that the printing system 10 may include only one finisher or more than two finishers, depending upon the needs of the system 10 and/or the user.

Local controls (not shown) orchestrate the production of printed or rendered pages, their transportation over various path elements (e.g., 22, 24, 26, and 28), and their collation and assembly as job output by the finishers 14, 18. Rendered (or printed) pages or sheets may include images received via facsimile, transferred to the document processing system from a word processing, spreadsheet, presentation, photo editing or other image generating software, transferred to a document processor over a computer network or on a computer media, such as, a CD ROM, memory card or floppy disc, or may include images generated by the image input devices of scanned or photographed pages or objects.

Thus, the output at the first finisher 14 may consist of, for example, monochrome sheet sets from the first marking engine 12, a monochrome sheet set from the first marking engine 12 with color inserts from the second marking engine 16, a monochrome sheet set from the first marking engine 12 with MICR inserts from the second marking engine 16, or a monochrome sheet set from the first marking engine 12 with monochrome inserts from the second marking engine 16. Likewise, the output at the second finisher 18 may consist of color, MICR or monochrome sheet sets from the second marking engine 16 or color, MICR, or a monochrome sheet set from the second marking engine 16 with monochrome inserts from the first marking engine 12.

The "rotate and redirect" paper paths 22, 24 shown in FIG. 1 take in either a monochrome or color print stream and rotate the sheets (or pages) of print media (or paper) and change their feed direction approximately 90 degrees to insert into the alternate engine print stream where scheduled. This may be accomplished, for example, via two independently driven nip sheet rotators similar to that used in the C.P. Bourg DS5000 or the Xerox Nuvera FTM (Finisher Transport Module) or the like. Of course, it is to be understood that there are also other means to provide rotate and translate functions as known to those skilled in the art.

It should also be understood that the marking engines 12 and 16 may be oriented other than at a 90 degree angle to one another, such as in a linear configuration. Another possible configuration would be including only the first marking engine 12 with a pair of finishers 14 and 18. In this configuration, the merging module 20 would be situated between all three components, thus forming a "T."

The two marking engines 12 and 16 can print and deliver their outputs simultaneously and independently shown by the following in FIG. 1. The first "bypass" path 26 is where a decision gate diverts, for example, monochrome sheets from the first marking engine 12 down and under the appropriate rotate and redirect path 22 or 24 and then back up to the proper level so that the sheets can exit to the first finisher 14. Likewise, the second "bypass" path 28 is where a decision gate diverts, for example, the color sheets from the second marking engine 16 up and over the appropriate rotate and redirect path 22 or 24 and then back down to the proper level so that the sheets can exit to the to the second finisher 18. The first and second "bypass" paths 26, 28 are at approximately 90 degrees to one another.

The merging module 20 may also incorporate a multi-page buffer 30 such that n number of sheets (e.g., color) can be scheduled and printed ahead and then held in the buffer 30 until they are needed to be fed into the print stream. Thus, for example, this would enable a low speed color marking engine to be used along with a high speed monochrome marking engine.

Thus, for instance, let us assume that a 100 ppm (pages per minute) monochrome marking engine (first marking engine 12) and a 25 ppm color marking engine (second marking engine 16 are mated with the merging module 20 for a mixed output print job. If the merging module 20 includes a five-page buffer 30, then up to five consecutive color pages could be RIPped, scheduled, printed and held in the buffer 30 until they are needed. In this manner, up to five consecutive color pages could be inserted into the monochrome print stream without any slow down of the monochrome marking engine 12. More than five consecutive color pages would require dead cycles of the monochrome engine for the amount of time needed for the color engine to print the required next page. An appropriate buffer size (i.e., >1) would need to be determined.

The general operation of the printing system 10 and the merging module 20 is described below. Let us continue to assume, for purposes of discussion, that the first marking engine 12 is a monochrome marking engine and that the second marking engine 16 is a color marking engine. It is to be understood, of course, that other combinations of marking engines are contemplated. In this case, FIGS. 2 and 3 represent views of the merging module 20 from the monochrome engine 12 (marking engine 1) side and the color engine 16 (marking engine 2) side, respectively.

Figure 2:
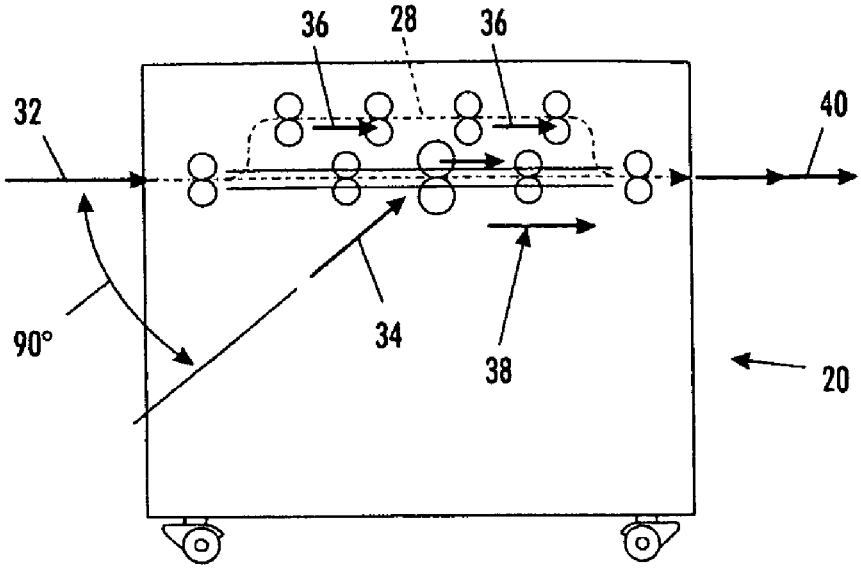
FIG. 2 represents a schematic view of the merging module from the first marking engine side.

Turning our attention to FIG. 2 first, as represented by arrow 32, color prints would enter the merging module 20. As represented by the arrow 34, monochrome prints would enter the merging module 20 at approximately a 90 degree angle from the color prints. As represented by the arrows 36, color prints would follow the upper bypass path 28. As represented by the arrow 38, monochrome prints would enter path 22, be rotated, and then redirected into the color print stream. The output 40 would be color prints with monochrome inserts.

Figure 3:
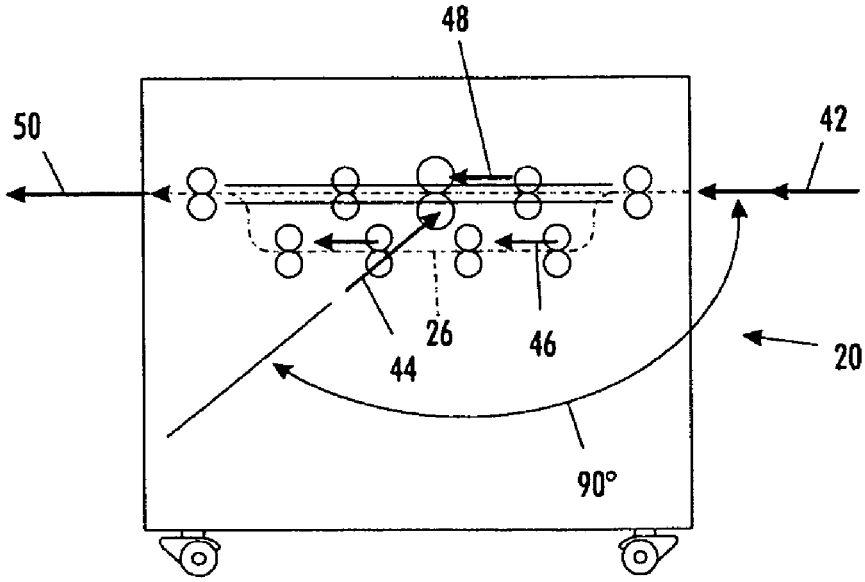
FIG. 3 represents a schematic view of the merging module from the second marking engine side.

Turning now to FIG. 3, as represented by arrow 42, monochrome prints would enter the merging module 20. As represented by the arrow 44, color prints would enter the merging module 20 at approximately a 90 degree angle from the monochrome prints. As represented by the arrows 46, monochrome prints would follow the lower bypass path 26. As represented by the arrow 48, color prints would enter path 22, be rotated, and then be merged into the color print stream. The output 50 would be monochrome prints with color inserts.

Figure 4:
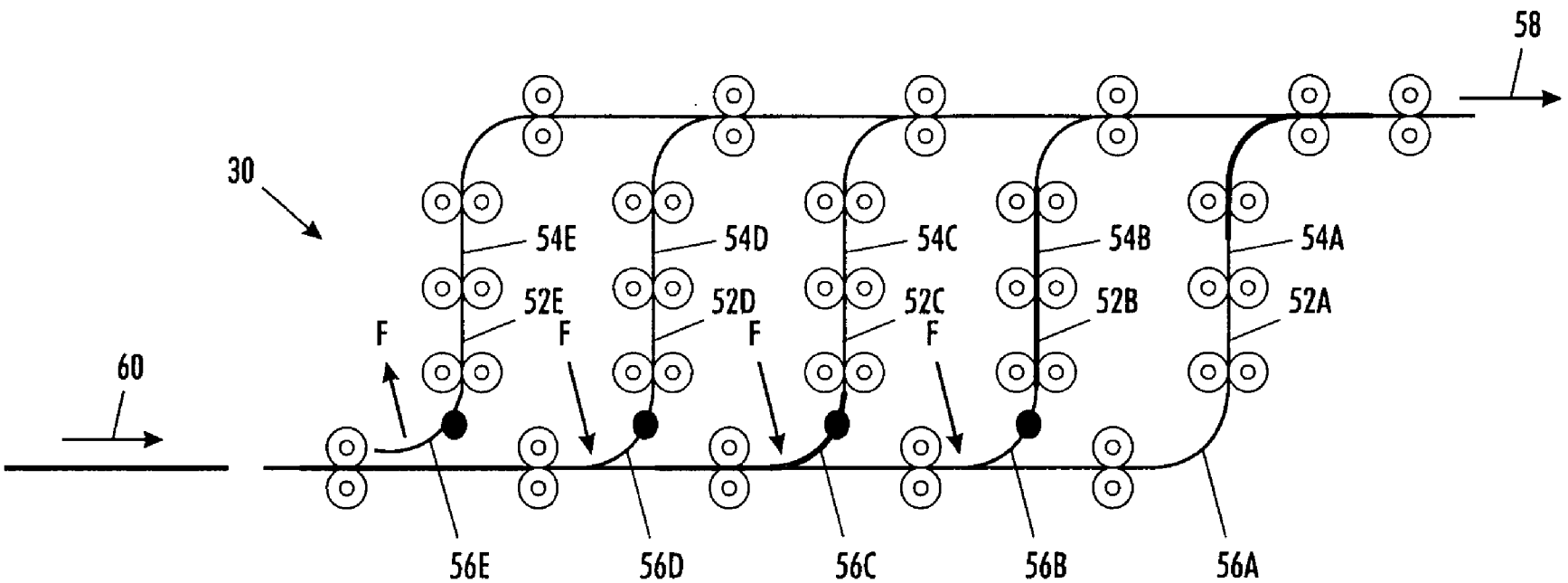
FIG. 4 is a block diagram of the buffer shown in FIG. 1.

FIG. 4 shows the multi-sheet buffer 30 in more detail. As shown in FIG. 4, the buffer 30 is a five-sheet buffer. It is to be understood, however, that the multi-page buffer 30 may contain any number of sheet buffers 52. Each sheet buffer 52 is long enough and wide enough to contain the largest sheet entirely that the systems are capable of handling. Each buffer path 54 has a controllable decision gate 56 to direct the sheets to enter it upon demand. Each sheet buffer 52 has separate drive control of the nip rollers for each buffer path 54 to allow the sheet to be transported, stopped and restarted as needed. A paper sensor may be included to sense where the sheet lead or trail edge is in the path. The paper sensor could be located, for example, near the lead edge of the sheet when it is held in the buffer. All buffer paths 54 merge to an exit transport 58 to enter the merging module 20. As represented by the arrow 60, sheets may enter the multi-page buffer 30 from the second marking engine 16.

In FIG. 4, an arrow "F" represents the direction of the decision gate actuation force. For example, when the arrow F is pointed down, the gate is located in a manner to guide the sheet into the respective buffer. When the arrow F points upward, it allows the sheet to pass by the respective buffer to the next downstream buffer. Thus, the first buffer path 54A is shown feeding a sheet out. In regard to the second buffer path 54B, a decision gate 56B is down and a sheet is stopped in the buffer. In regard to the third buffer path 54C, a decision gate 56C is down and a sheet is being driven into the buffer. In regard to fourth buffer path 54D, a decision gate 56D is down and preparing for the next sheet to enter the buffer. In regard to the fifth buffer path 54E, the decision gate 56E is up as the previous sheet passes to the fourth buffer.

The mixed output printing system 10 described herein can be used to mate and control various combinations of marking engines, including, but not limited to, the following combinations:

monochrome+color
monochrome+MICR
color+MICR
monochrome+monochrome
color+color
MICR+MICR In operation, a mixed output color-monochrome print job may be decomposed into separate color and monochrome print jobs. The color pages would be RIPped and sent to the color marking engine, while the monochrome pages would be RIPped and sent to the monochrome marking engine. For example, if page 7 is the first color page in a set, it is printed on the color marking engine and delivered to the buffer where it is held in buffer bin #1. Once page 7 is recognized as a color page, a merging controller scheduler (not shown) may be used to schedule the monochrome printer to skip page 7 (skip a pitch) in the monochrome job and the color insert is fed from the buffer bin #1 into the skipped pitch location in the job. This scenario repeats for each color page in the set.

The merging controller scheduler may be based, for example, on a software program such as Xerox Corporation's FreeFlow™ Output Manager. Output Manager has monochrome/color job splitting capability as well as the capability of load balancing Gob splitting) across multiple printers. The merging controller scheduler generally consists of a separate PC on which a software program such as FreeFlow and the controls for the merging module 20 could reside. Also, the merging controller scheduler could become an additional module in FreeFlow such as where Output Manager is located.

The merging controller scheduler keeps track of which color page is located in which buffer bin location. Whenever a color page is fed from a buffer bin, the next color page is scheduled to be printed and delivered to the empty buffer bin location until the required number of sets is completed and the end of job is encountered.

For job validation purposes, particularly for MICR check insertion jobs, the following characteristics may be tracked and incremented/decremented for each page as the job is processed: Job #, Set #, page #, bin location, color printer page #, monochrome printer page #.

The color pages are "printed ahead" of the monochrome job such that the color page buffer is maintained in a full state. This enables pairing low speed (and low cost) color and high speed monochrome printers together.

If the number of consecutive color pages in a job is larger than the buffer size, then dead cycles need to be scheduled for the monochrome marking engine for the amount of time needed for the color marking engine to print the required next page and deliver it to the merging module 20.

The color and monochrome print jobs can run simultaneously, thereby delivering completed first sets faster than current state of the art whereby the color marking engine must complete all the color pages prior to running the monochrome job.

The multi-sheet buffer 30 enables the ability to feed color inserts in any order from the full buffer enabling the ability to reorder the color inserts on the fly. One way in which this might be useful is to "hold" defective prints in the buffer 30 and reschedule and replace the defective print with a "good" print. The defective prints can then be fed out at a convenient time such as after the set or job is completed.

Whenever a color page is inserted into a black page stream the color page is directed to the rotator transport by a gate. One or more sensors (not shown) in the rotator transport may detect the sheet presence and location and apply the rotation algorithm to the sheet. Once the sheet is rotated, the lead edge location of the sheet is sensed and the sheet is accelerated to a velocity to match the bypass transport paper speed and the color page is rotated and redirected into the monochrome print stream.

Thus, by way of example, the embodiments described above can be useful to connect two monochrome marking engines that run at either the same or different speeds in the arrangement shown in FIG. 1 or any other preferred arrangement such as in a linear configuration. For marking engines of the same nominal 100 pages per minute speed, no two run at exactly the same speed. For instance, one marking engine might run 100.1 ppm, and another marking engine might run 98.8 ppm. During a one minute job length they will produce different numbers of pages. The buffer 30 can be used to synchronize cluster printing between two slightly different speed engines storing at least one page in the buffer to avoid skipping pitches.

There are also cases where two monochrome marking engines in the arrangement shown in FIG. 1 or any other preferred arrangement get out of synchronization due to scheduled operations such as automatic adjustments like toner concentration adjustment, image processing time variation due to simple or complex images, paper misfeed or multi-feed, jam clearance actions, etc., which interrupt the normal full productivity. The buffer can be used to "absorb" some of these occurrences so that one monochrome engine acts as the master and the other the buffered slave. For cases where the master has a failure, the slave can take over the job and complete the pages.

For two monochrome marking engines of the same or different speeds in the arrangement shown in FIG. 1 or any other preferred arrangement running duplex mode for an internal racetrack duplex architecture printer, the controller scheduler and the buffer can be used to effectively double the ppm throughput rate. The controller scheduler may be set up to run duplex mode prints on both engines alternating between the two engines. For example, the first marking engine 12 begins printing side 1 for duplex pages 1, 2, 3, 4 for a 4 page duplex path system. When the second marking engine 16 starts printing side 2, it also begins printing sides 1 of pages 5, 6, 7, 8. The first marking engine 12 completes side 2 and delivers the pages 1, 2, 3, 4 through the merging module 20 to the appropriate finisher. The second marking engine 16 then completes pages 5, 6, 7, 8 and delivers them to the buffer 30, to the merging module rotator, and then to the appropriate finisher. The ideal buffer size is one which is equal to the duplex path length in pages plus one page to absorb any speed variation between marking engines.

The merging concept described above enables higher utilization of high speed third party finishing devices by having more than one printer feed pages to the finishing device. The throughput rate for many commercial finishing devices is significantly higher than the printers speed. By mating two printers via the merging module 20, the page throughput rate can be doubled for the finisher thereby improving its utility. The approximately 90 degree rotation direction in the merging module 20 can be controlled via the merging controller scheduler to enable customization if required.

Dual Rotators

Figure 5:
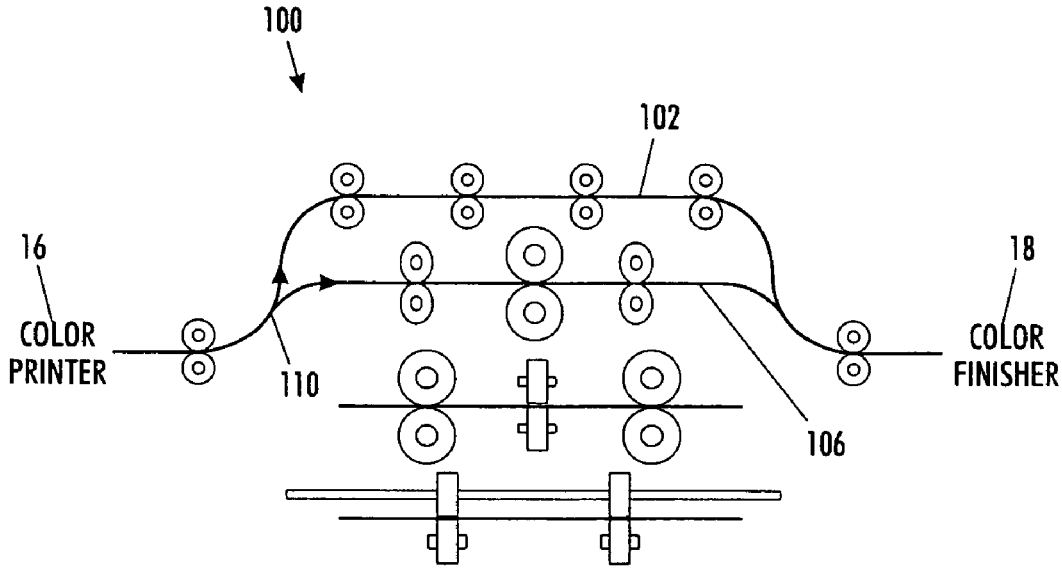
FIG. 5 represents a schematic view of an alternative merging module from the first marking engine side.
Figure 6:
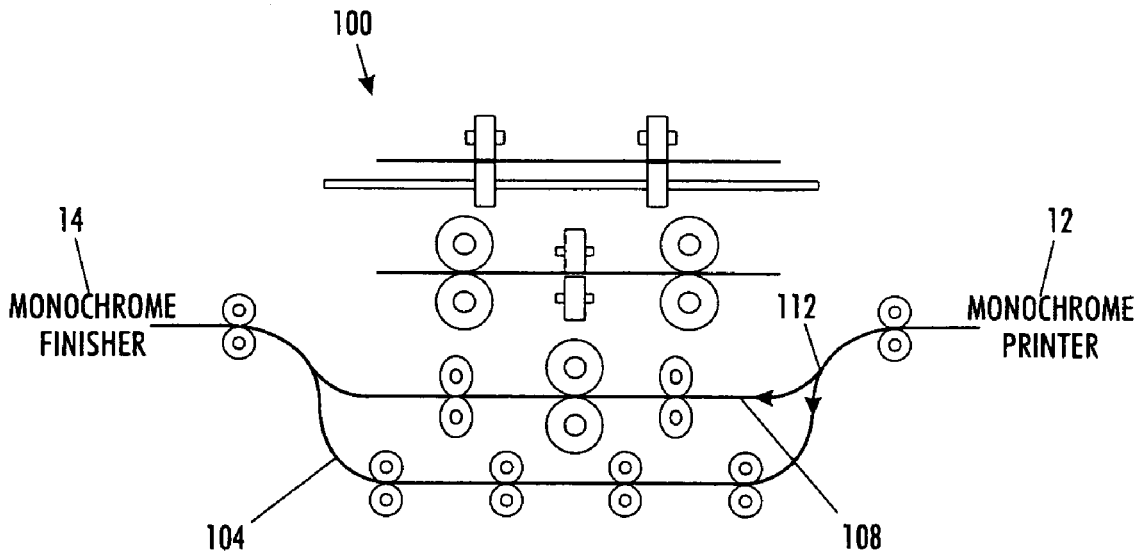
FIG. 6 represents a schematic view of the alternative merging module from the second marking engine side.

Alternatively, a second rotator may be added to the merging module 20 to enable sheets from either print engine to be rotated and delivered to either finisher as desired. Thus, the single rotator merging module 20 may be replaced by a dual rotator merging module 100 that contains a pair of rotators. As shown in FIGS. 5 and 6, the dual rotator merging module 100 contains at least four paper paths, including a first (or upper) bypass path 102 (e.g., for color sheets), a second (or lower) bypass path 104 (e.g., for monochrome sheets), a first merge paper path 106 (e.g., for color sheet), and a second merge paper path 108 (e.g., for monochrome sheets). The dual rotator merging module 100 also includes at least two decision gates 110, 112. FIG. 5 represents the view from the first marking engine (e.g., monochrome) 12 side, while FIG. 6 represents the view from the second marking engine (e.g., color) 16 side.

The upper bypass path 102 is where the first decision gate 110 diverts the color sheets up and over the merge path 106 and then back down to the proper level so that the sheet can exit to the color finisher 18. The lower bypass path 104 is where the second decision gate 112 diverts the monochrome sheets down and under the merge path 108 and then back up to the proper level so that the sheet can exit to the monochrome finisher 14.

The upper merge paper path 106 takes color pages in the same plane and, for example, while the monochrome pages are sent straight through the lower bypass transport, the color pages are rotated and merged into the monochrome print stream where scheduled. This may be accomplished via two independently driven nip sheet rotators similar to that used in the CP Bourg DS5000 or the like. Likewise, the lower merge paper path 108 takes monochrome pages in the same plane, and, for example, while the color pages are sent straight through the upper bypass transport, the monochrome pages are rotated and merged into the color print stream where scheduled. This also may be accomplished via two independently driven nip sheet rotators.

Color sheets exit from the color marking engine 16 on the left and are transported to the merge path 106, where they are diverted via the gate 110 into the upper color bypass path 102. The color sheets are then merged back into the merge path 106 prior to exiting on the right to the color finisher 18.

Monochrome pages travel from front to rear in the lower bypass transport 104 from the monochrome marking engine 12 toward the monochrome finisher 14. Color inserts enter the color rotate and merge path 106 from the left, the diverter gate 110 is activated to guide the sheets into the color rotate and merge transport 106. Sheets are rotated 90 degrees and then are exited to the rear and merged into the monochrome print stream, which is following the lower monochrome bypass transport path 104, exiting to the monochrome finisher 14 at the rear.

As shown in FIG. 6, paper enters from the monochrome marking engine 12 on the right into the merge path and is diverted via-the gate 112 into the lower monochrome bypass transport 104 and merges back prior to exiting to the left to the monochrome finisher 12. Color pages are traveling from front to rear in the upper color bypass transport 102 from the color marking engine 16 toward the color finisher 18. Monochrome inserts enter the merge path 108 from the right, the diverter gate 112 is activated and sheets enter the monochrome rotate and merge path 108. Monochrome sheets are rotated 90 degrees and then are exited to the rear and merged into the color print stream, which is following the upper bypass transport path 102, exiting to the color finisher 18 at the rear.

Jam Clearance

Clearing paper jams in the merging module 20 as shown in FIGS. 1-4 may be challenging due to the limited access to the three layered paper path. Jam clearance can be accomplished through the top of the merging module 20. However, this can be inconvenient for the user who might have to open three successive levels of transport baffles to access all the sheets. With the 90 degree crossing paper paths, the multi-layered paper transport baffles would need to be hinged at 90 degrees to one another, making it somewhat more difficult to open them. To provide improved jam clearance, an area in the main paper path analogous to the buffer module 30 either prior to or after the actual merging module 20 (or the dual rotator module 100) may be added so that a means can be provided to access the paper path from the front side of the module 20. Two different configurations are shown in FIGS. 7 and 8.

Figure 7:
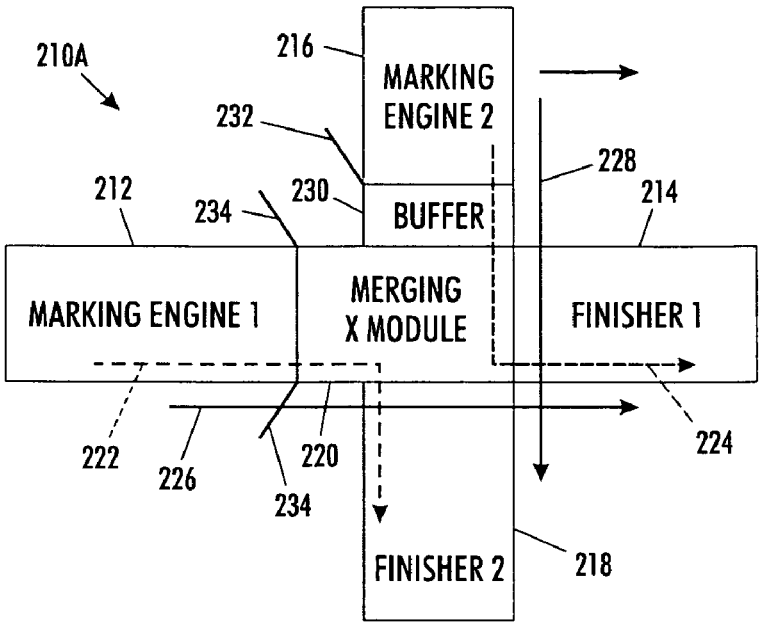
FIG. 7 is a simplified block diagram of an image rendering system incorporating an alternative merging module and buffer.
Figure 8:
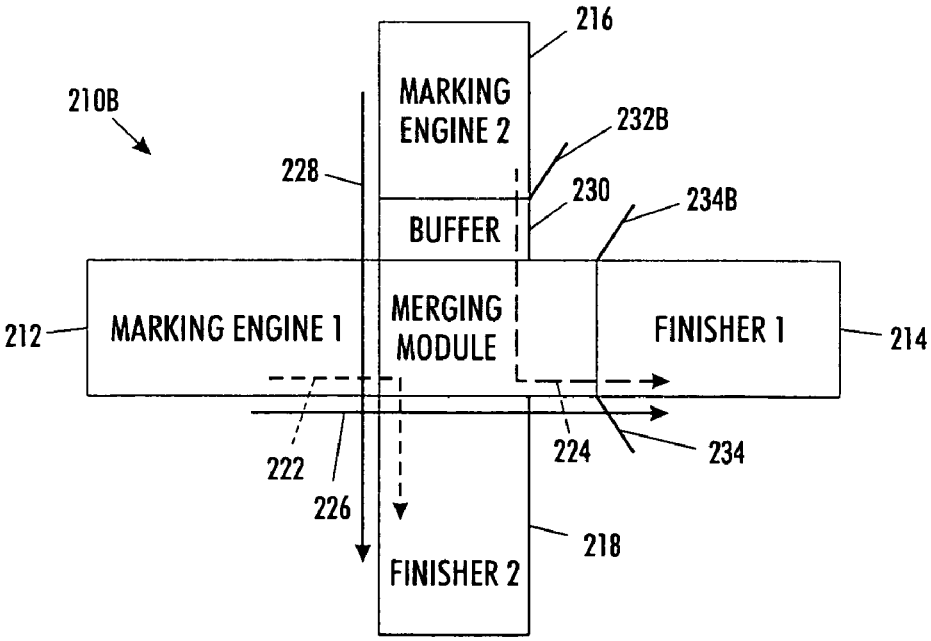
FIG. 8 is a simplified block diagram of an image rendering system incorporating an alternative merging module and buffer.

With reference now to FIG. 7, an alternative image rendering system 210A is shown. The image rendering system 210A is similar to the image rendering system 10 shown in FIG. 1 in that it includes a first marking or printing engine 212 (e.g., a monochrome, color or MICR marking engine), a corresponding first finisher 214, a second marking engine 216 (e.g., a color, MICR or second monochrome marking engine), and a corresponding second finisher 218. The image rendering system 210 further includes a merging module 220 for mixed output print control, which contains several paths for print media (e.g., paper), including a pair of "rotate and redirect" paths 222, 224, a pair of bypass paths 226, 228, and a buffer 230. The system 210 differs from the original system 10 in that it includes multiple jam clearance doors. Thus, as shown in FIG. 7, a buffer jam clearance door 232 may be located on the buffer 230 closest to the first marking engine 212, while one or more doors 234 may be located on the merging module 220, closest to the first marking engine 212.

It is to be understood, however, that any number of jam clearance doors could be included and that these jam clearance doors could be located elsewhere. Thus, FIG. 8 shows an alternative system 210B. In this system, the buffer jam clearance door 232 is shown located on the buffer 230, near the first finisher 214, while the jam clearance doors 234 are shown located on the merging module 220, near the first finisher 214.

Figure 9:
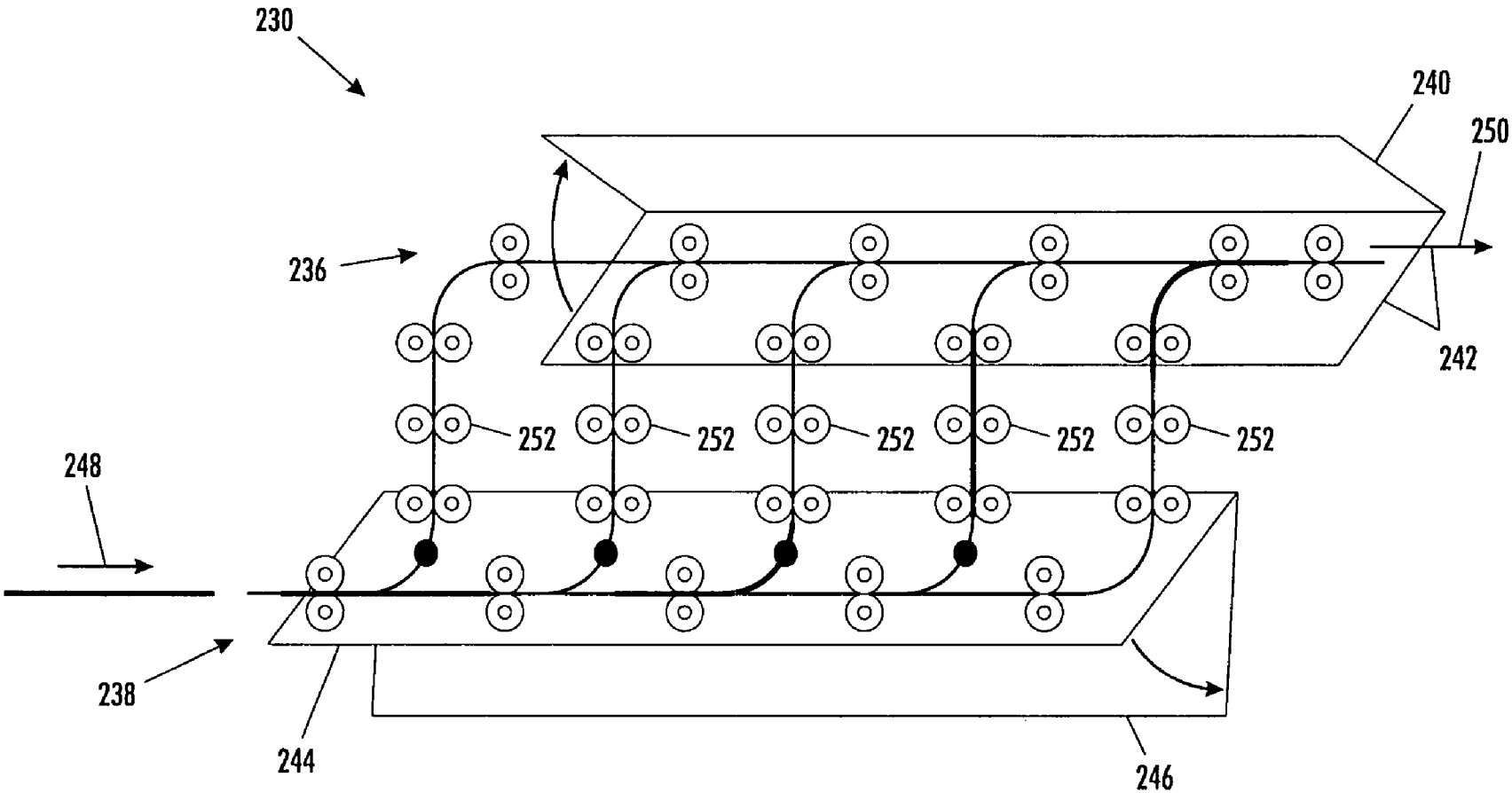
FIG. 9 is a block diagram of the alternative buffer shown in FIG. 7.

FIG. 9 illustrates that buffer area jam clearance may be enabled by structuring the buffer 230 with upper and lower bypass transports 236 and 238, respectively. The upper bypass transport 236 includes an upper baffle 240 and a lower baffle 242 that open from the front and are hinged at the rear. Likewise, the lower bypass transport 238 includes an upper baffle 244 and a lower baffle 246 that open from the front and are hinged at the rear. The upper bypass transport baffle 240 rotates upward, while the lower bypass transport baffle 246 rotates downward to facilitate jam clearance. As shown in FIG. 9, prints enter the buffer 230 via the lower bypass transport 238 (as referenced by the arrow 248), while prints leave the buffer 230 via the upper bypass transport 236 (as referenced by the arrow 250). Also, the buffer 230 includes at least one manual knob 252 for each buffer drive roll shaft in the buffer 230.

Thus, the buffer area sheets may be cleared through the following process (with reference to the FIG. 7). Initially, the buffer jam clearance door 232 is opened. The lower bypass transport lower baffle 246, which is hinged at the rear, is opened, the accessible sheets in the direction of paper travel are removed, and the lower baffle 246 is closed.

The upper bypass transport upper baffle 240, which is hinged at the rear, is opened, and the accessible sheets are cleared, with the upper baffle 240 being left open.

Next, the manual knob 252 on the buffer drive roll shafts is turned to advance the buffer sheets to the upper bypass transport area 236 and the sheets are removed. Alternatively, the buffer drive rolls can either (a) operate individual shafts, (b) all be tied together via drive belts and one way clutches so that one knob drives the drive nips for all n buffers or (c) a jam cycle-down scenario can be implemented that drives all sheets out of the buffers into the top transport but disengages the top transport drives so that all buffer sheets are located accessible in the top transport for jam clearance. Only truly jammed sheets would need the manual jam clearance knob use. The upper bypass transport upper baffle 240 and the buffer jam clearance door 232 are then closed.

Figure 10:
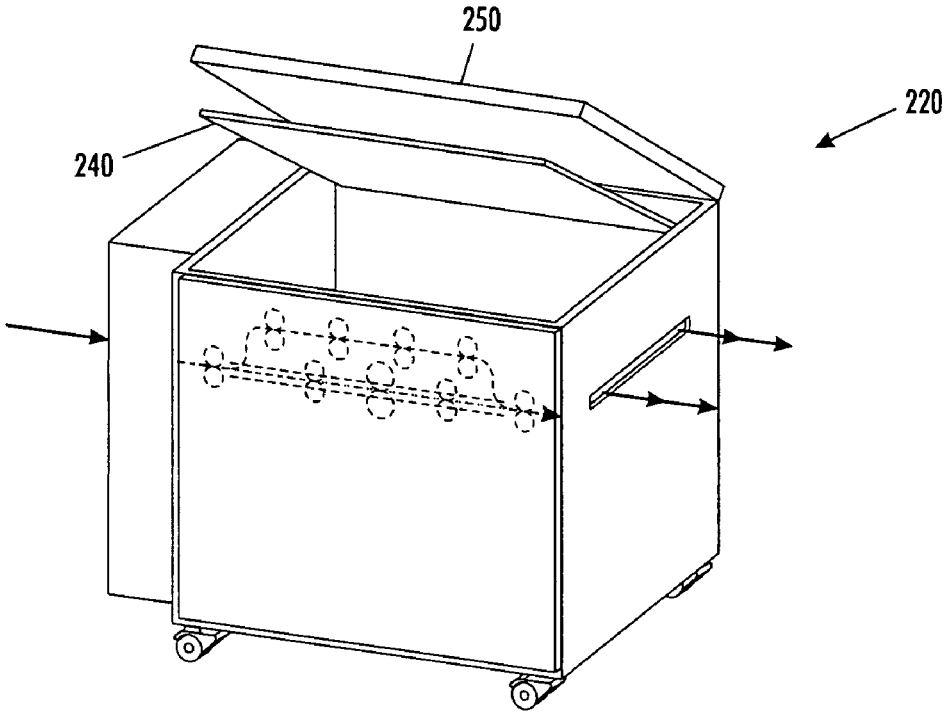
FIG. 10 is a perspective view of the alternative merging module shown in FIG. 7 with the top cover in an open position.

With reference now to FIG. 10, upper bypass transport 236 jam clearance may be accomplished, for example, by allowing for the top cover 250 of the merging module 220 to open upwards sufficiently far but less than 90 degrees to enable jam clearance. It may be hinged at the first finisher 214 end and the upper baffle 240 of the upper bypass transport 236 opens upward also less than 90 degrees and is also hinged at the first finisher 214 end. The top cover 250 and the upper bypass transport upper baffle 240 may be supported by gas springs or counterbalances for ease of use. The upper bypass transport upper baffle 240 can also be tethered to the top cover 250 so that the baffle 240 is opened automatically when the operator opens the top cover 250.

Jam clearance may be accomplished, for example, by opening the top cover 250, opening the upper bypass transport upper baffle 240, removing the jammed sheets, closing the upper transport upper baffle 240, and closing the top cover 250.

Figure 11:
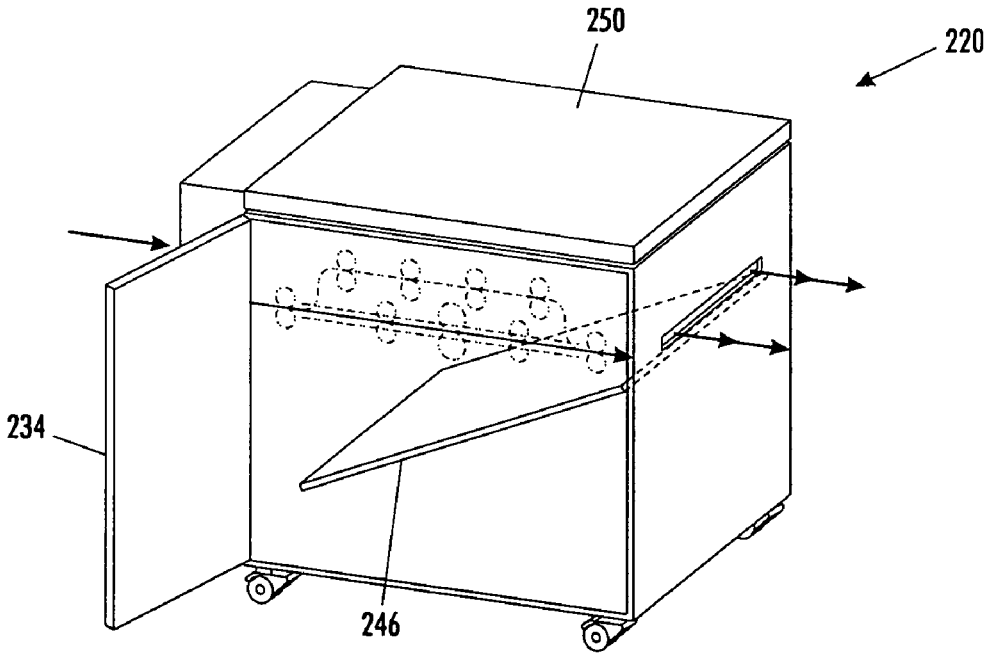
FIG. 11 is a perspective view of the alternative merging module shown in FIG. 7 with the side cover in an open position.

With reference now to FIG. 11, lower bypass transport 238 jam clearance may be accomplished, for example, through the side door 234. Since the lower bypass transport 238 is generally for paper traveling 90 degrees to the upper bypass transport 236, the jam clearance is made easier if the baffle opening is hinged 90 degrees to the upper bypass upper baffle 236. The lower bypass transport lower baffle 246 is therefore hinged at the second finisher 218 side and opens downward. The lower bypass transport lower baffle 246 may be supported by counterbalances to counterbalance the baffle weight and make jam clearance easier.

Lower bypass transport clearance may be accomplished, for example, by opening the second door 234, unlatching the lower bypass transport lower baffle 246, swinging the lower baffle 246 down, removing the sheets, and closing the lower baffle 246.

Figure 12:
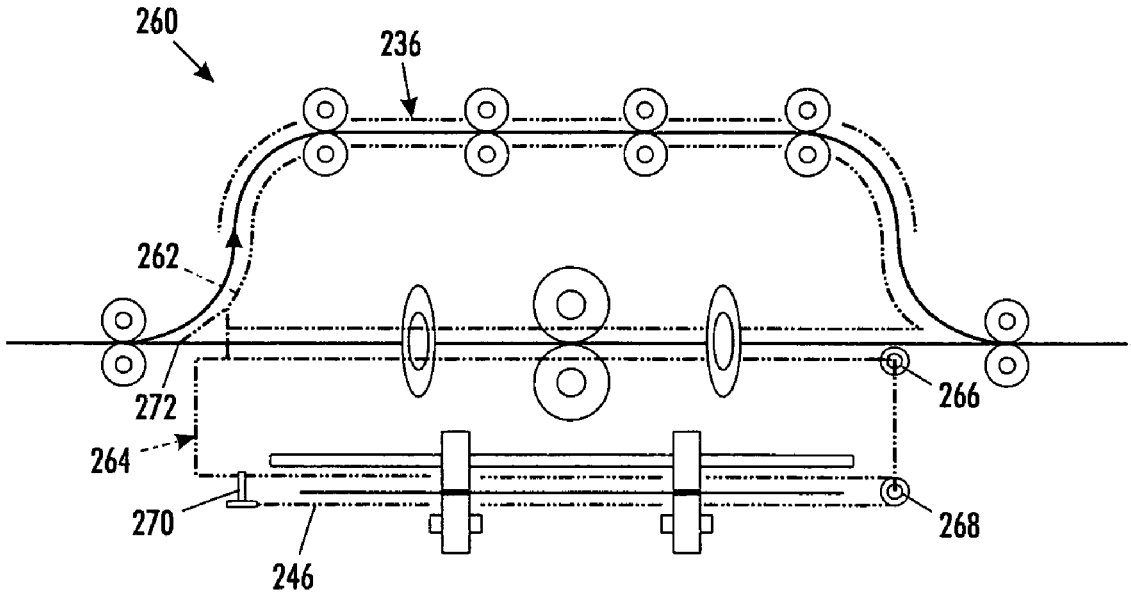
FIG. 12 is a sectional view of the rotation transport from the first marking engine side.

Rotator transport jam clearance in the merging module 220 may be challenging at times since the sheets may be traveling in either of two perpendicular directions depending upon which paper path is being utilized and which sheet the jam occurred on. It is possible to accomplish jam clearance of these two perpendicular paper paths by clearing one direction from the top and the other direction from the bottom. FIG. 12 shows the rotation transport 260 viewed from the first marking engine 214 side. The rotation transport 260 includes an upper baffle 262 and a lower baffle 264. As shown in FIG. 12, the lower rotation transport 260 includes a hinge 266. Likewise, the lower bypass transport lower baffle includes a hinge 268.

For clearing sheets traveling in the direction from the second marking engine 216 and buffer module 230 into the merging module 220 (or the dual rotator merging module described above), it may be more convenient for the operator to access the sheets from the top since the upper transport upper baffle 240 is hinged at the first finisher 214 end already. It is possible to hinge the sheet rotator transport upper baffle 262 at the first finisher 214 end so that it can also be opened upward for jam clearance. Pin locators 270 may be added to accurately locate the rotator transport upper and lower baffles 262 and 264 to each other so that adequate registration and skew performance is achieved. For example, at least one locating pin might be located on the rotator transport upper baffle 262 located outside the paper path so as not to interfere with the sheets transport and projecting 90 degrees from the transport plane. A corresponding hole for the locating pin to enter could be located on the rotator transport lower baffle 264 such that when the upper and lower baffles are closed, the locating pin enters the locating hole and precisely locates the upper and lower transport baffles relative to each other.

For clearing sheets traveling in the direction from the first engine 214 into the merging module 220, it may be more convenient for the operator to access the sheets from the bottom since the lower bypass transport lower baffle 246 is hinged at the second finisher end 218 already. It is relatively simple to hinge the sheet rotator transport lower baffle 264 at the second finisher 218 end so that it can also be opened downward for jam clearance. The same pin locators would likely be added to accurately locate the rotator transport upper and lower baffles 262 and 264 to each other so that adequate registration and skew performance is achieved.

In this embodiment, motors (not shown) that provide the sheet rotation function may be packaged in the space between the upper transport upper and lower baffles 240 and 242 or in the space between the lower transport upper and lower baffles 244 and 246. Depending upon the mass of the motors and drives, it may be more practical to have that portion of the transport remain fixed. If this is the case, then it would be preferable to locate the drive motors in the space between the lower transport upper baffle and the rotator transport lower baffle. This would require clearing the rotator transport always from the top but does eliminate the need to lower and then raise a heavy lower portion of the rotator transport.

Sensors (not shown) in the paper path could be used to determine which direction the jammed sheet occurred in. The machine logic would then direct the operator to the easiest means to clear the jam as described above. It is also possible to always provide jam clearance access from only one direction.

Thus, for example, for a monochrome job with color inserts, jam clearance would entail opening the side door 234, lowering the lower bypass transport lower baffle 246 and removing the jammed sheets, lowering the rotation transport lower baffle 264 and removing the jammed sheets, closing the baffles 246, 264, and closing the side door 234.

With respect to the upper bypass transport 236, paper enters from IOT on left into the merge path, is diverted via a gate 272 into the upper bypass transport 236 and merges back prior to exiting on the right.

With respect to the lower bypass transport 238, paper enters from IOT in front into the merge path, is diverted via the gate 272 into the lower bypass transport 238 and merges back prior to exiting to the rear.

With respect to rotation transport for monochrome inserts, color pages are traveling left to right in the upper bypass transport from the second marking engine 216. Monochrome inserts enter the merge path from the front, the diverter gate 272 is not activated and sheets enter the rotation transport 260. Sheets are rotated 90 degrees and then are exited to the right and merged into the color print stream, which is following the upper bypass transport path 236.

With respect to rotation transport for color inserts, monochrome pages are traveling from front to rear in the lower bypass transport 238 from the first marking engine 214. Color inserts enter the merge path from the left, the diverter gate 272 is not activated and sheets enter the rotation transport 260. Sheets are rotated 90 degrees and then are exited to the rear and merged into the monochrome print stream, which is following the lower bypass transport path 238.

Variable Size Buffer

The image rendering systems 10 and 210 described above generally include a fixed size mechanical buffer 30 in order to enable slower speed color engines to be used in conjunction with higher speed monochrome engines. However, the fixed size mechanical buffer 30 can buffer no more than a fixed, pre-determined number of color (or MICR) sheets to be inserted into the monochrome print stream. This may not be adequate for multiple color insert jobs greater then the number of mechanical buffers and cause the monochrome system to slow down until the color engine can catch up.

Figure 13:
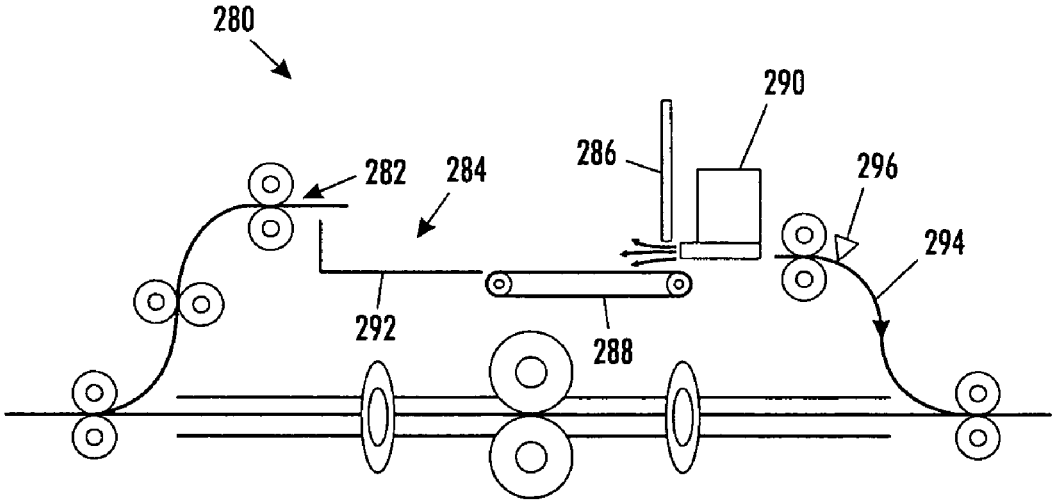
FIG. 13 is a sectional view of a variable size buffer.

With reference now to FIG. 13, a large, variable quantity buffer 280 that is either separate from or integral with the merging module 20 (or the dual rotator merging module 100) may be included. The variable quantity buffer 280 allows the customer to print mixed mode (e.g., monochrome+color or monochrome+MICR) jobs automatically as a single integrated job at the highest possible productivity while still allowing the customer the flexibility to use that same equipment to run separate monochrome and color or MICR jobs simultaneously without reconfiguring the hardware.

For the same example as above, where a 100 ppm monochrome marking engine and a 25 ppm color marking engine are mated with a merging module that contains an integral variable size buffer in a mixed output job, up to 100 consecutive color pages could be RIPped, scheduled and printed then held in the buffer tray until they are needed and then up to 100 consecutive color pages could be inserted into the monochrome print stream without any slow down of the monochrome engine. More than 100 consecutive color pages may require skip pitches of the monochrome engine for the amount of time needed for the color engine to print the required next page.

The variable size buffer 280 typically consists of simplified versions of recirculating document handler feeder or bottom VCF duplex tray feeder technologies and includes: an exit nip roll set and sheet corrugator 282 to eject the sheet into the feed tray 284, a right side wall 286 where the sheets exiting the corrugator 282 contact and begin to fall and settle into a stack, a VCF feeder 288 projecting through the feed tray to acquire and feed the bottom sheet to the exit transport 294, an air knife 290 which blows air at the paper stack to separate and levitate the stack of paper such that only the bottom sheet is fed, a feed tray bottom plate 292, which supports the stack of sheets and which the VCF feeder projects through, and a registration sensor 296 to sense the sheet lead or trail edge in the paper path. The feed tray 284 is a relatively flat area where the sheets can be stacked and "buffered." The bottom plate 292 of the feed tray 284 has an area cut out where the VCF feed head belt protrudes through to acquire the sheet via its vacuum belt.

Alternatively, bottom feed friction retard feeders (not shown) could be used, depending on whether coated stocks are desired to be fed located in place of the VCF feeder and in the air knife. The variable size buffer 280 may be located in either the upper bypass path or in the lower bypass path.

Utilizing a variable size buffer 280 may reduce the footprint of the merging module 20 by incorporating the buffer 280 integrally into the upper bypass transport 236. The upper transport 231 includes an upper baffle 233 and a lower baffle 234 that open from the front and are hinged at the rear, thus reducing the need for an additional buffer module and jam clearance access. This embodiment also enables a large quantity of color pages (e.g., up to 100) to be held in the variable size buffer for virtually unrestricted productivity and enables the use of very different speed color and monochrome print engines where color speed is less than monochrome speed due to the large buffer. Thus, productivity may be increased by not requiring the monochrome engine to slow down for the color engine to catch up.

Multiple Merging Modules

Alternatively, more than one merging module may be utilized in the system to provide the user with the ability to print from three or more engines (e.g., monochrome, color and MICR) automatically as a single integrated system or insert jobs, while still allowing the user the flexibility to run each individual piece of equipment simultaneously without reconfiguring the hardware. Thus, multiple (i.e., 2, 3, or even 4 or more) printers of the same kind (e.g., MICR, monochrome or color), may be connected together to effectively multiply the individual device throughput speed. This may be accomplished by providing two or more merging modules that each connect two print systems at 90 degrees to one another, for example. Of course, the print systems may be connected in other configurations, such as linear configurations. Each merging module may include dual rotators and dual bypass paths (one above and one below the rotator as described above) to route the two paper paths around the rotator and thus enable both print systems to deliver their output to the respective finishing device.

Figure 14:
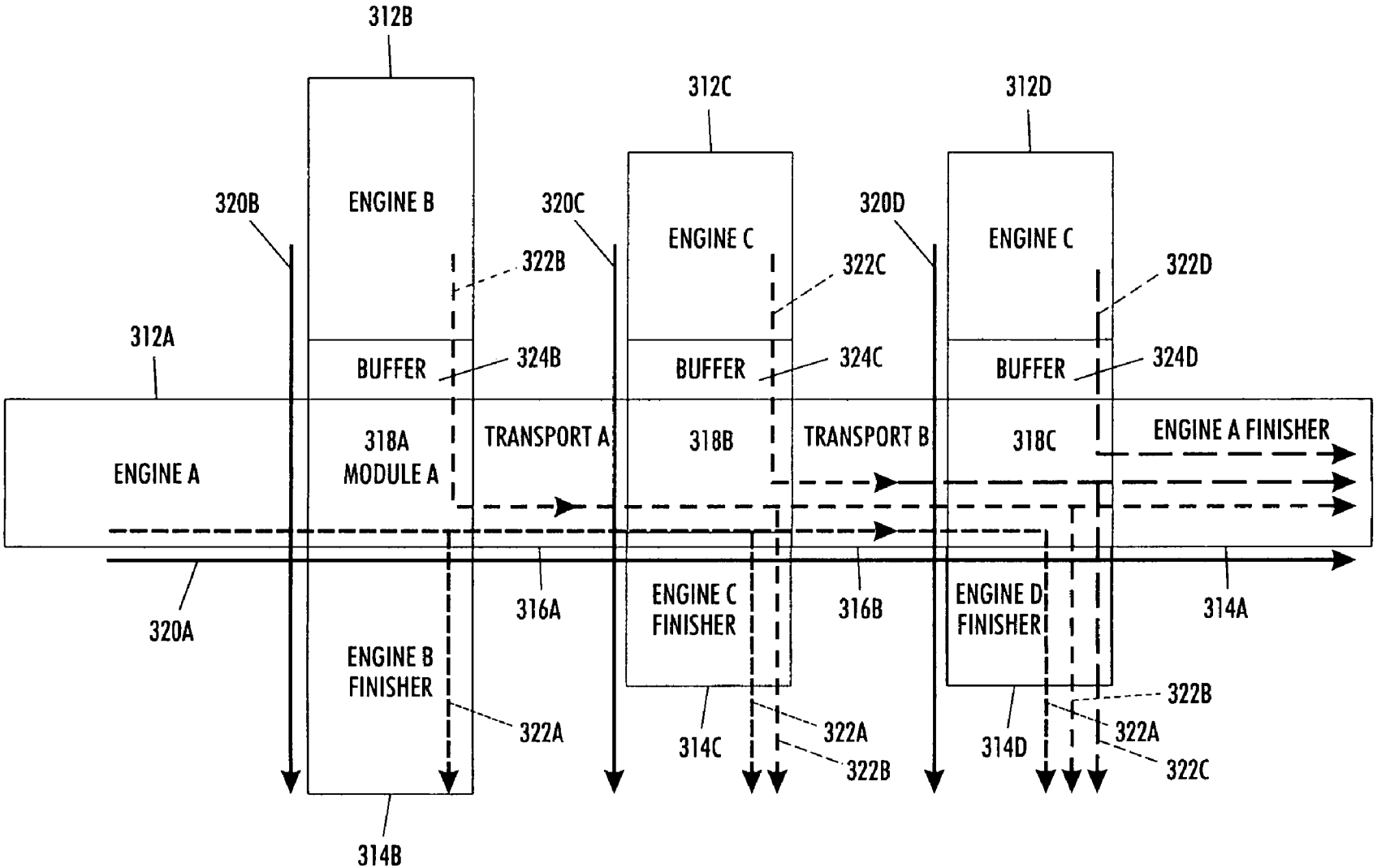
FIG. 14 is simplified block diagram of an alternative image rendering system incorporating multiple merging modules.

In this regard, FIG. 14 shows an alternative print system 310, which includes multiple print engines 312 and corresponding finishers 314. Likewise, the print system 310 includes multiple transports 316 and merging modules 318.

The merging modules 318 can be configured to accommodate common production print engine families. Each merging module 318 typically contains an integrated secondary paper path buffer and four paper paths, as described more fully below.

In this example, two "rotate" paper paths 322 (e.g., 322A and 322B), one for each of the primary and secondary paper paths 312 from engines 312A and 312B, (a) take in prints from the primary engine 312A and the secondary engine 312B at 90 degrees to one another, (b) rotate the pages and (c) send them out of the merging module 318A at 90 degrees to the entry direction to the alternate engine finishing device 314B.

A primary engine "bypass" path 320A is included. This is where a decision gate diverts the primary engine 312A sheets up and over the rotators in the merging module 318A and then back clown to the proper level so that the sheet can exit to the primary finisher 314A.

A secondary engine "bypass" path 320B is also included. This is where a decision gate diverts the sheets from the secondary engine 312B down and under the rotators and then back up to the proper level so that the sheet can exit to the secondary finisher 314B.

The paper paths for the primary engine 312A and the secondary engine 312B are at 90 degrees to one another. To arrange the printers into a tree requires the addition of at least one simple transport module 316 between successive merging modules as shown in FIG. 14. The transport module 316 gives the operator room to operate the system and also determines the service envelope in front of and behind each engine 312.

An integrated multi-sheet buffer 324 for the merging module 318A may be located in the secondary paper path. The secondary paper path is the path that the alternate monochrome, color or MICR pages would feed from. The use of a variable size buffer as described above may reduce the size of the system by elimination of the multi-sheet buffer.

Control of the printers as an integrated system may be accomplished by use of a single controller and utilizing the "clustering" and mono-color job splitting capability available with DocuSP. The multiple merging controller scheduler may be based, for example, on a software program such as Xerox Corporation's FreeFlow™ Output Manager. Output Manager has monochrome/color job splitting capability as well as the capability of load balancing (job splitting) across multiple printers. The multiple merging controller scheduler, optional buffers, transports and finishers 314 control generally resides on a separate PC on which a software program such as FreeFlow and the controls for the merging modules 20 could reside. Also, the multiple merging controller scheduler could become an additional module in FreeFlow such as where Output Manager is located.

Operation of the printers independently may be enabled by a controller (not shown). There are at least three operating modes in this system: manual mode, single engine/standard finishing mode, and single engine/alternate finishing mode.

In manual mode the controller relinquishes control of the specific printer allowing an operator to run the system manually using the standard on-board controller sending the output to its finishing device via the secondary bypass path through the merging module.

In single engine/standard finishing mode, the controller maintains control of the entire system and automatically sends jobs and schedules them to run on an individual printer in the system, sending the output to that particular printer's finishing-device via the secondary bypass path through the merging module.

In single engine/alternate finishing mode the controller maintains control of the entire system and automatically sends jobs and schedules them to run on an individual printer but also sends the output to an alternative downstream finishing device via the rotator path through the merging module.

The use of multiple merging modules may enable the user to select and send a job to any downstream finishing device on the tree on an as-needed basis to avoid two sheet rotations and improve reliability provided the paper dimensions can be accommodated through the merging module in either orientation, and the use of an integrated buffer in the merging module greatly simplifies the page scheduling complexity by making its purpose simply "maintain the buffer at full page capacity" and not having to control every page in real time. Also, multiple merging modules may increase useable floor space compared to multiple separate print engines in a single room due to the physical connections between the engines, while arranging all inputs on one side of the main trunk and all Qutputs on the other side may improve operations workflow efficiency.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first print engine that produces output to a print stream, wherein the output comprises at least one sheet of print media;

a second print engine that produces output to the print stream, wherein the output comprises at least one sheet of print media;

a merging module connected between the first and second print engines to receive the output from each of the print engines, wherein the merging module includes at least two sheet rotators, at least two decision gates and at least three sheet paths, the sheet paths comprising at least an upper bypass path, a lower bypass path, and a merge path;

a sheet buffering apparatus coupled to the merging module for buffering the output from each of the print engines, wherein the sheet buffering apparatus includes an upper bypass transport having an upper baffle and a lower baffle that open from the front and are hinged at the rear; a lower bypass transport that includes an upper baffle and a lower baffle that open from the front and are hinged at the rear; and wherein the upper bypass transport baffle rotates upward and the lower bypass transport baffle rotates downward to facilitate jam clearance; and at least one finisher connected to the merging module.

2. The printing system defined in claim 1 wherein the first print engine comprises a monochrome print engine, a MICR print engine, or a color print engine.

3. The printing system defined in claim 1 wherein the second print engine comprises a monochrome print engine, a MICR print engine, or a color print engine.

4. The printing system defined in claim 1 wherein the output from the first print engine enters the merging module at approximately a 90 degree angle with respect to the output from the second print engine.

5. The printing system defined in claim 1 wherein the merging module contains an additional merge path.

6. The printing system defined in claim 1 wherein the sheet buffering apparatus comprises:

an exit nip roll set and sheet corrugator to eject each sheet into a feed tray;

a right side wall where the sheets exiting the corrugator contact and begin to fall and settle into a stack of a sheets;

a VCF feeder projecting through the feed tray to acquire and feed the sheets to an exit transport;

an air knife to separate and levitate the stack of sheets such that only the bottom sheet is fed;

a feed tray bottom plate that supports the stack of sheets and which the VCF feeder projects through has an area cut out where the VCF feed head belt protrudes through to acquire the sheet via a vacuum belt; and a registration sensor to sense the sheet lead or trail edge in the paper path.

7. The printing system defined in claim 1 further comprising at least one jam clearance door on the sheet buffering apparatus and at least one jam clearance door on the merging module.

8. An apparatus for an image rendering system having at least two marking engines producing output consisting of sheets of print media for at least one finisher, the apparatus comprising:

a merging module connected between a first marking engine and a second marking engine for processing output from each of the first and second marking engines, the merging module including at least two sheet rotators, at least two decision gates, and at least four sheet paths, the sheet paths comprising an upper bypass path, a lower bypass path, a first merge path, a second merge path; and sheet buffering means comprising an exit nip roll set and sheet corrugator to eject the sheet into a feed tray, a right side wall where the sheets exiting the corrugator contact and begin to fall and settle into a stack, a VCF feeder projecting through the feed tray to acquire and feed the sheet to the exit transport, an air knife to separate and levitate the stack of paper such that only the bottom sheet is fed, a feed tray bottom plate that supports the stack of sheets and which the VCF feeder projects through, and a registration sensor to sense the sheet lead or trail edge in the paper path.

9. The apparatus defined in claim 8 wherein output from the first marking engine enters the merging module at approximately a 90 degree angle with respect to output from the second marking engine.

10. The apparatus defined in claim 8 wherein the sheet buffering means comprises:

a plurality of sheet buffers, each sheet buffer being long enough to contain the largest sheet length entirely; and a plurality of buffer paths, wherein each buffer path has a controllable decision gate to direct the sheets and each sheet buffer has separate drive control of a plurality of nip rollers for each buffer path to control the sheet.

11. A mixed output printing system comprising:

a first print engine that produces output to a print stream;

a second print engine that produces output to the print stream;

a first merging module connected between the first and second print engines to receive the output from the first and second print engines, wherein the first merging module includes a first sheet buffering apparatus at least two decision gates, and at least three sheet paths, the sheet paths comprising an upper bypass path, a lower bypass path, and a merge path, wherein the first sheet buffering apparatus comprises an exit nip roll set and sheet corrugator to eject the sheet into a feed tray, a right side wall where the sheets exiting the corrugator contact and begin to fall and settle into a stack, a VCF feeder projecting through the feed tray to acquire and feed the sheet to the exit transport, an air knife to separate and levitate the stack of paper such that only the bottom sheet is fed, a feed tray bottom plate that supports the stack of sheets and which the VCF feeder projects through, and a registration sensor to sense the sheet lead or trail edge in the paper path;

a first finisher for receiving output from the first merging module;

a first transport module that transports the print stream from the first merging module to a second merging module that is located between a third print engine, the first transport module and a second finisher, a fourth print engine that produces output to the print stream; and a second transport module that transports the print stream from the second merging module to a third merging module connected between the fourth print engine and a third finisher and a fourth finisher, wherein the third and fourth finishers receive the output from the third merging module and wherein the second merging module includes second sheet buffering apparatus and the third merging module includes a third sheet buffering apparatus.

12. The printing system defined in claim 11 wherein the output from the first print engine enters the first merging module at approximately a 90 degree angle with respect to the output from the second print engine and the output from the third print engine enters the second merging module at approximately a 90 degree angle with respect to the output from the fourth print engine.

13. The printing system defined in claim 11 wherein the first merging module contains an additional merge path.

14. A xerographic printing system comprising:

a first print engine that produces output to a print stream, wherein the first print engine comprises a monochrome print engine, a MICR print engine, or a color print engine;

a second print engine that produces output to the print stream, wherein the second print engine comprises a monochrome print engine, a MICR print engine, or a color print engine;

a merging module connected between the first and second print engines to receive the output from each of the print engines, wherein the merging module includes at least two sheet rotators, an upper bypass path, a lower bypass path, a first merge path, a second merge path, and at least two decision gates;

a sheet buffering apparatus coupled to the merging module for buffering the output from each of the print engines;

at least one finisher connected to the merging module;

at feast one jam clearance door on the sheet buffering apparatus and at least one jam clearance door on the merging module, wherein the sheet buffering apparatus includes an upper bypass transport having an upper baffle and a lower baffle that open from the front and are hinged at the rear; and a lower bypass transport that includes an upper baffle and a lower baffle that open from the front and are hinged at the rear, wherein the upper bypass transport baffle rotates upward and the lower bypass transport baffle rotates downward to facilitate jam clearance.

15. The xerographic printing system defined in claim 14 wherein the sheet buffering apparatus comprises:

an exit nip roll set and sheet corrugator to eject the sheet into a feed tray;

a right side wall where the sheets exiting the corrugator contact and begin to fall and settle into a stack;

a VCF feeder projecting through the feed tray to acquire and feed the sheet to the exit transport;

an air knife to separate and levitate the stack of paper such that only the bottom sheet is fed;

a feed tray bottom plate that supports the stack of sheets and which the VCF feeder projects through; and a registration sensor to sense the sheet lead or trail edge in the paper path.

* * * * *